United States Patent [19]

Musall et al.

[11] 4,004,888

[45] Jan. 25, 1977

[54] EXHAUST GAS CLEANING ARRANGEMENT WITH A RESILIENTLY SUPPORTED MONOLITHIC CERAMIC CATALYZER

[75] Inventors: Reimar Musall; Wilhelm Wolsing, both of Hannover, Germany

[73] Assignee: Kali-Chemie Aktiengesellschaft, Hannover, Germany

[22] Filed: Dec. 11, 1975

[21] Appl. No.: 639,911

Related U.S. Application Data

[63] Continuation of Ser. No. 349,414, April 9, 1973, abandoned.

[30] Foreign Application Priority Data

Apr. 7, 1972 Germany ..... 2216644

[52] U.S. Cl. ..... 23/288 FC; 138/108; 138/112

[51] Int. Cl.[2] ..... B01J 8/00; F01N 3/15

[58] Field of Search ..... 23/288 F, 288 FC; 60/299; 138/112, 108

[56] References Cited

UNITED STATES PATENTS

| | | | |
|---|---|---|---|
| 3,211,534 | 10/1965 | Ridgway | 23/288 F X |
| 3,247,665 | 4/1966 | Behrens | 23/288 FC UX |
| 3,410,651 | 11/1968 | Brandenburg et al. | 23/288 FC UX |
| 3,441,381 | 4/1969 | Keith et al. | 23/288 FC |
| 3,441,382 | 4/1969 | Keith et al. | 23/288 FC |
| 3,594,131 | 7/1971 | DePalma et al. | 23/288 F |
| 3,597,165 | 8/1971 | Keith et al. | 23/288 FC |
| 3,692,497 | 9/1972 | Keith et al. | 23/288 FC |
| 3,751,917 | 8/1973 | Garcia | 23/288 FA X |
| 3,798,006 | 3/1974 | Balluff | 23/288 FC |
| 3,801,289 | 4/1974 | Wiley | 23/288 FC |
| 3,817,714 | 6/1974 | Wiley | 23/288 FC |
| 3,841,839 | 10/1974 | Wiley | 23/288 FC |
| 3,841,842 | 10/1974 | Wiley | 23/288 FC |

*Primary Examiner*—Barry S. Richman
*Attorney, Agent, or Firm*—Ernest F. Marmorek

[57] ABSTRACT

An apparatus for decontaminating exhaust gases having a rigid metallic housing, a catalyzer body of the monolithic type placed in the housing, the latter serving simultaneously as the outer wall of an exhaust gas conduit, a shell surrounding the catalyzer, a resilient compensating device supporting the catalyzer and the shell within the housing axially therein and with a gap with the housing.

The resilient compensating device is formed by resilient tongues engaging the shell which surrounds the catalyzer body, and resilently supports and centers the shell in and spaced spart from the housing.

9 Claims, 8 Drawing Figures

EXHAUST GAS CLEANING ARRANGEMENT WITH A RESILIENTLY SUPPORTED MONOLITHIC CERAMIC CATALYZER

This is a continuation of application Ser. No. 349,414, filed Apr. 9, 1973, and now abandoned.

CROSS-REFERENCE TO OTHER APPLICATIONS

Applications of Reimer Musall et al, as follows: Ser. No. 347,559 filed Apr. 13, 1973, now U.S. Pat. No. 3,945,803 issued Mar. 23, 1976; Ser. No. 349,477 filed Apr. 9, 1973, now U.S. Pat. No. 3,947,252 issued Mar. 30, 1976; Ser. No. 578,712 (Continuation of Ser. No. 376,338), pending; Ser. No. 376,388 filed July 5, 1973, pending; and Ser. No. 333,714 filed Feb. 20, 1973 now U.S. Pat. No. 3,891,396 issued June 24, 1975.

FIELD OF THE INVENTION

The present invention rélates to an elastic support for a ceramic monolithic body which can be used as the catalyzer carrier preferably in devices used in the decontamination of exhaust gases.

BACKGROUND OF THE INVENTION

The use of ceramic catalyzer carriers having a honeycomb structure for the cleaning of exhaust gases, especially for the cleaning of the exhaust gases of automobiles, has been already known. Such honeycomb structures combine two advantages: on one hand they possess a large surface with respect to a unit volume, on the other the flow resistance through them is very small. The difficulty of their use in devices for the decontamination of exhaust gases of automobiles resides in their required elastic suspension. The pushing forces and vibrations which occur during the travelling of the car place a heavy mechanical requirement on the honeycomb structure so that finally this will lead to a destruction of the catalyzer carrier.

Elastic suspension for such honeycomb structures have been already proposed, such as by U.S. Pat. No. 3,441,382, which describes a catalyzer patron which exists from a ceramic monolithic catalyzer element placed in a metallic housing and in which between the catalyzer and the housing wall is placed, such as fire resistant brick, or molten aluminum oxide etc. By means of a metallic spring, which can be adjusted, a pressure is applied to the insulating mass so that the catalyzer body is retained fixedly in its position. Such suspension turned out to be, however, not sufficiently elastic. The pressure applied to the body of the catalyzer is too large and is not uniformly distributed in order to be able to prevent an eventual mechanical destruction of the honeycomb structure.

Another device for the catalytic decontamination of the exhaust gases of automobiles has been described in German DAS 1,476,507. In such device the monolithic catalyzer is placed in a cylindrical housing between a pair of annular flanges which are in gas-tight connection with the housing. Into the annular gap between the housing and the catalyzer a resilient wavy member is placed which can be in form of a corrugated or wavy wire mesh which surrounds the catalyzer body very tightly. The experience of the automobile industry, especially in the case of high revolution four-cycle engines, proves that the wavy-shaped wire mesh inserts cannot withstand the high thermal and mechanical loading to which the exhaust system might be exposed and soon will lead to a destruction of the catalyzer body.

SUMMARY OF THE INVENTION

It is, therefore, an object of the present invention to provide an improved apparatus for decontaminating exhaust gases in which the catalyzer body is securely but resiliently supported in a metallic housing in an elastic fashion preventing the destruction of the catalyzer body due to forces acting radially and longitudinally.

According to the present invention the apparatus for decontaminating exhaust gases comprises a rigid metallic housing, a catalyzer body of the monolithic type is placed in the housing which serves simultaneously as the outer wall of an exhaust gas conduit, a shell surrounding the catalyzer body, a resilient compensating device for supporting the catalyzer body and the shell within the housing axially therein and with a gap with the housing.

BRIEF DESCRIPTION OF THE DRAWINGS

The invention will become more readily apparent from the following description of preferred embodiments thereof shown in the accompanying drawings, in which.

DESCRIPTION OF THE PREFERRED EMBODIMENTS

Figure 1:
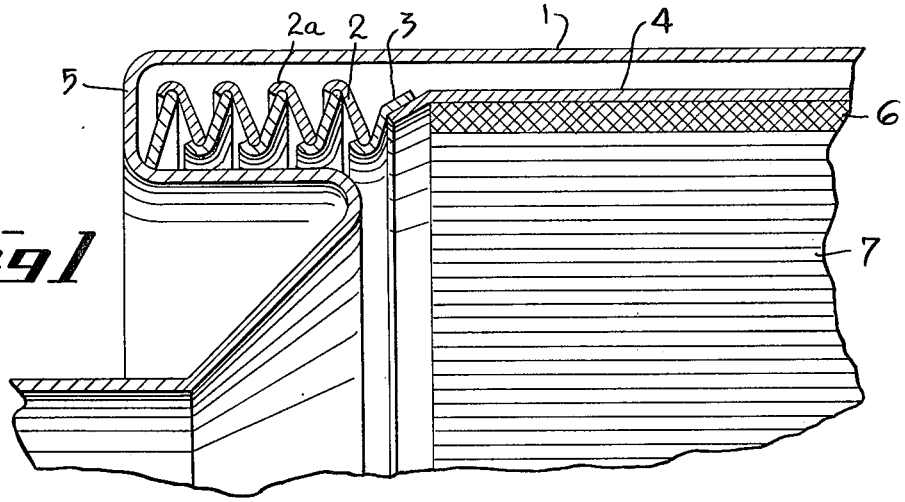
FIG. 1 is a longitudinal section through the apparatus according to the present invention having plate springs as the resilient supporting means therein.

With reference to FIG. 1 it is seen that the apparatus according to the present invention comprises a rigid metallic housing 1 in which a plate spring 2 having flanges 2*a*, and a conically bent end portion 3 abutting against the conically bent end portion of the spanning sleeve 4 which can be constructed as a single cylindrical sleeve or made up of several segments and supports a catalyzer body 7 in an elastic fashion within the housing 1. In order to avoid damage to the catalyzer body 7 there is an insert 6 placed between the body 7 and the supporting sleeve 4 which insert can be in the form of mineral fibers or a mineral wool material. The structure of the catalyzer body 7 is similar to these mentioned in the above cross-referenced applications The housing at each end thereof has a pocket means 5 formed therein which pocket means 5 houses the plate springs 2. The plate spring at one end abuts against the bottom wall portion of the pocket 5 of the housing 1 and, at the other end, which is a conical end portion, abutts against the similarly shaped end portion of the sleeve 4. As a result, an elastic support of the catalyzer body 7 is obtained within the metallic housing 1. Obviously only a fourth section of the entire apparatus is shown since it is symmetrical with the remaining portions not illustrated. It is also noted that the housing 1 can be a part of the exhaust gas conduit itself, therefore, at one end of the housing 1 an entry for gases is provided, while at the other end an exit for the decontaminated gases is provided. This embodiment provides for an excellent elastic support of the catalyzer body 7 capable of withstanding radial and longitudinal shocks transmitted to the rigidly supported housing 1 when the vehicle is in movement or operational. It is noted that the formation of the plate springs 2 provides for a gas-tight sealing of the catalyzer body 7 within the sleeve 4 so that no exhaust gases can escape into the gap between housing 1 and sleeve 4.

Figure 2:
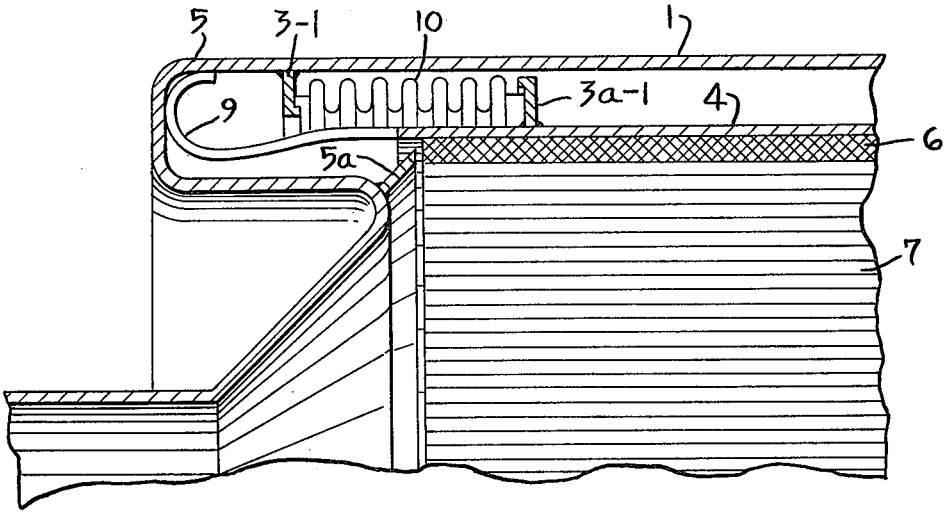
FIG. 2 is a similar cross-section as FIG. 1 for the apparatus according to the present invention in which the elastic spanning of the catalyzer body is performed by lug means provided in the pocket means formed at the end of the housing and the sealing of the catalyzer body is performed by an accordion-shaped compensating means.
Figure 3:
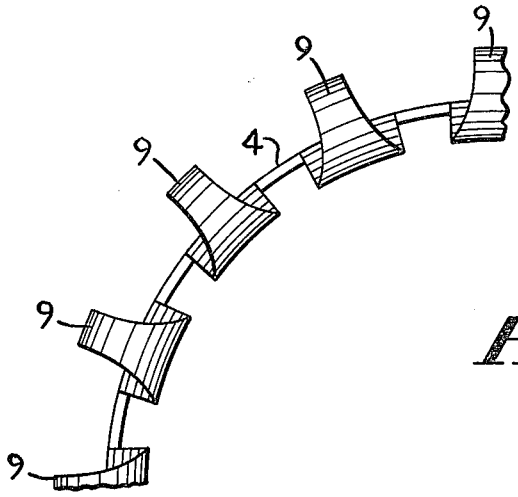
FIG. 3 illustrates an end view of the sheet-metal sleeve means of FIG. 2 with the supporting lug means.

Wtih reference to FIGS. 2 and 3 it can be seen that the apparatus has an accordion-shaped or corrugated compensating means 10 which is supported between stubs 3-1 and 3a-1 wherein stub 3-1 is fixedly mounted on the housing 1 and stub 3a-1 is fixedly mounted on the sleeve. Sleeve 4 itslef has lug-shaped or curled tongue-like extensions 9 formed thereon which, as it can be seen in FIG. 3, are circumferentially distributed over the end of sleeve 4 and which, at one arched end portion thereof abutts against the bottom portion of the pocket 5 and thereby in conjunction with the wave-shaped or accordion-shaped compensating means 10 provides an elastic support for the catalyzer body 7. In addition, the wave-shaped or corrugated compensating means 10 provides for a gas-tight sealing for the catalyzer body 7 so that no gases escape into the gap between housing 1 and the sleeve 4. A conical collar portion 5*a* is provided for a better reflection of the gases at both ends when the gases enter and leave the housing 1. As can be seen, here also a damping means 6 is provided between the catalyzer body 7 and the sleeve means 4.

It is noted in connection with this embodiment that the lug or tongue-like means 9 serve mainly for the elastic supporting of the catalyzer body between the housing 1 and, in the assembled condition, the lug means 9 are under certain spring bias in order to counter any compressional or pull forces which would tend to develop gaps between the catalyzer body 7 and the adjacent wall portions.

Figure 4:
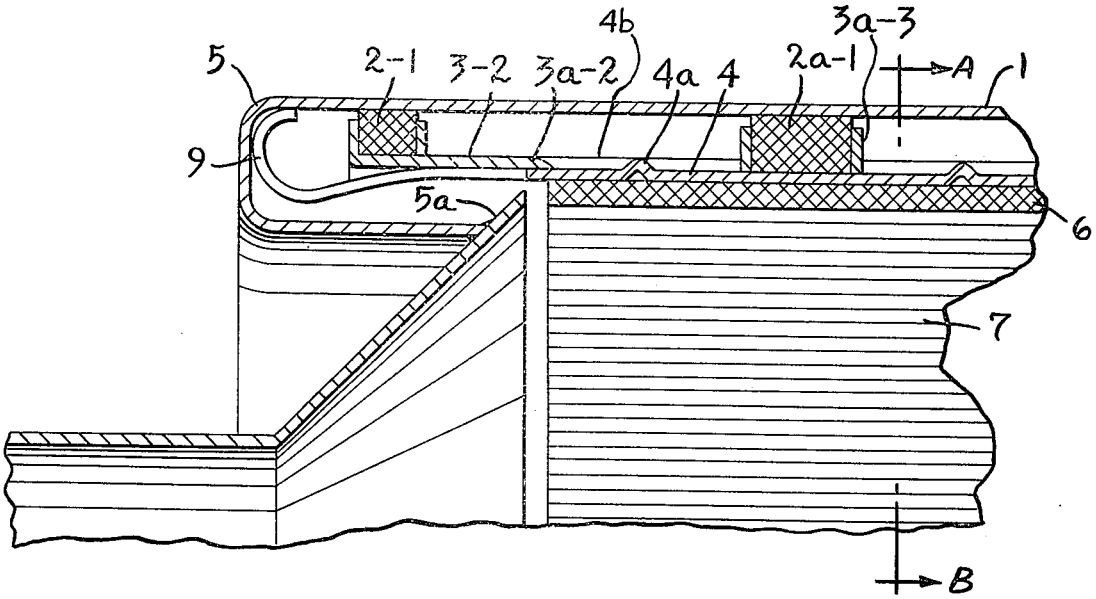
FIG. 4 is a longitudinal cross-section of FIGS. 1 and 2 having therein sealing rings instead of the accordion-shaped compensators.
Figure 5:
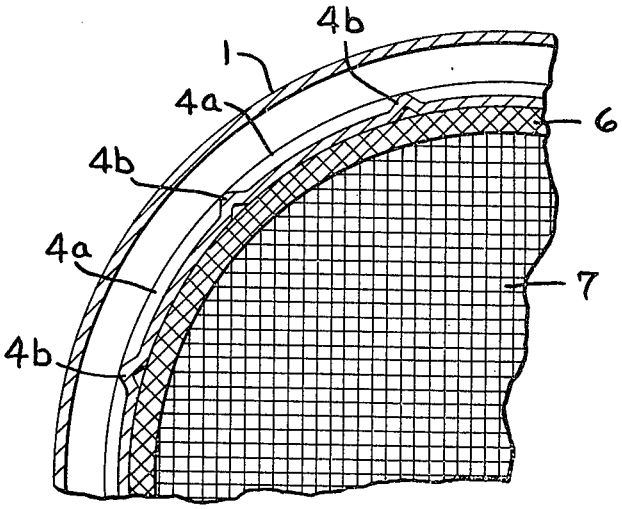
FIG. 5 is a cross-sectional view along the lines A-B in FIG. 4.

With reference to FIGS. 4 and 5 it is seen that the catalyzer body 7 is again contained within a metallic housing 1 within a sleeve 4 which can be either a single cylindrical element or consisting of a plurality of partial segments and, in which stiffening means 4*a* and 4*b* are provided for stiffening the sleeve 4. Again between the catalyzer body 7 and the sleeve 4 there is provided an insert 6 which is to dampen any movement between the catalyzer body 7 and the sleeve 4. In order to support the catalyzer body 7 and the supporting sleeve 4 within the housing 1, the sleeve 4 has similar lug portions 9 formed circumferentially thereon as in the above embodiment of FIG. 2 and which is placed under a spring bias when assembled into the pocket means 5 formed annularly at the end portions of the housing 1. In order to provide for the sealing of the catalyzer body 7 in a gas-tight fashion within the housing 1, sealing rings 2-1 and 2*a*-1 are supported with a distance with respect to each other by the provision of carrier means 3-2 which can be cut out or slit from the end portions of the sleeve 4 and formed with lugs 3*a*-3 bent up into a cup-shape so that the rings 2-1 and 2*a*-1 can be supported therein. However, the carrier means 3-2 can be parts of additional sleeve surrounding sleeve 4 and having the carrier portions 3-2 which are formed into the supporting cup portions 3a-3. The sealing rings 2-1 and 2a-1 can be made from a mineral material, in fiber form, or from foamed asbestos or from a wire mesh or wool-like material. As a variation for the mounting of the carrier means 3-2, they can be made as a ring and mounted on the lug or tongue-like means 9 or on the sleeve 4. The carrier means 3-2 can be formed as a single member or piecemeal.

Figure 6:
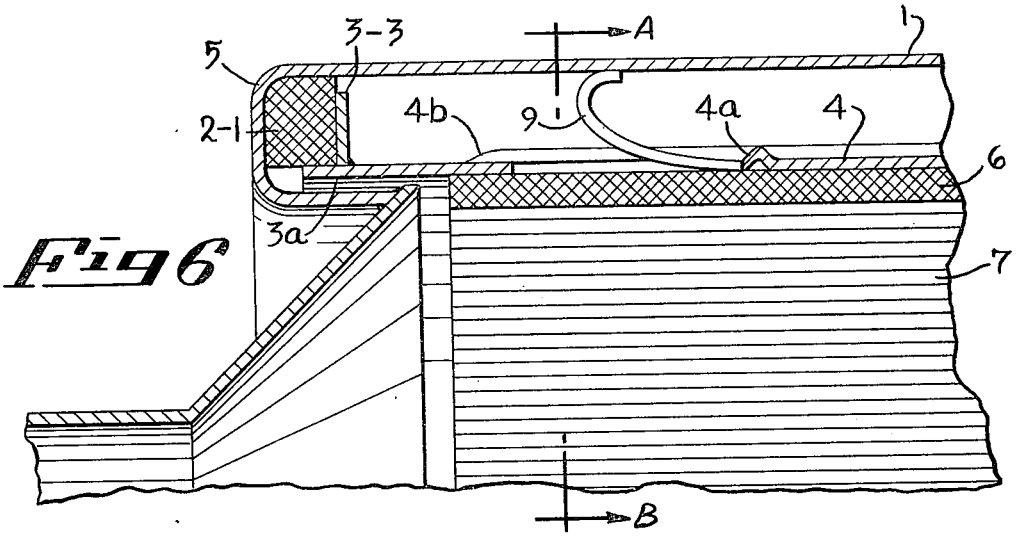
FIG. 6 is a longitudinal section of the catalyzer apparatus according to the present invention in which the supporting and elastic lug means are provided not in the end pocket means as seen in FIG. 1 but in the middle of the housing.
Figure 7:
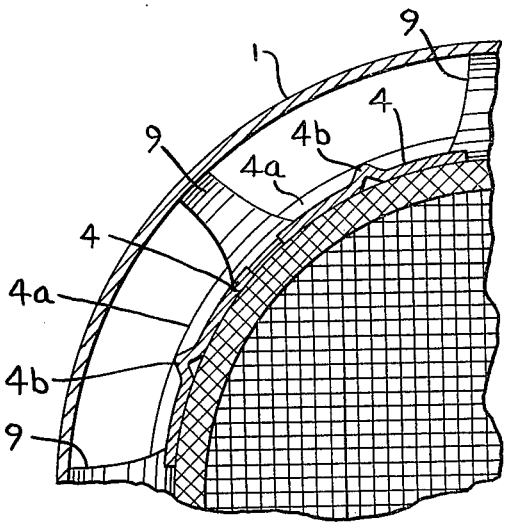
FIG. 7 is a cross-sectional view taken along the line A-B according to FIG. 6.

With reference to FIGS. 6 and 7 it can be seen that the catalyzer 7 again is supported within a housing 1 and having an intermediate damping means 6 placed between the catalyzer body 7 and the supporting sleeve 4 to dampen the radial forces through which the catalyzer body 7 might be exposed to shocks transmitted to the housing by the moving vehicle. At the end of the housing end pockets 5 are formed in an annular fashion which contain annular sealing rings 2-1 which provide for the gas-tight sealing of the catalyzer body 7 within the housing 1. The sleeve 4 is stamped to provide various supporting means thereon, such as lug means 9 are circumferentially stamped out, and which, in this embodiment, are at a position other than the pocket means 5 and support the catalyzer body 7 in an elastic fashion within the housing 1 at a location further away from the end portion of the housing. It is noted that the part not shown contains similar arrangement at the other end of the catalyzer body 7. The sleeve 4 is also stamped out to provide transverse stiffening means 4*a* and longitudinal stiffening means 4*b* and has also extensions 3*a* which is in the form of an abutting or supporting ring in which lug portions 3-3 are formed, which abut against the sealing ring 2-1. The elastic supporting of the present embodiment is due to the elastic lug means 9, while some longitudinal resiliency is provided also by the lug means 3-3 of the sleeve means 4 abutting against the sealing ring 2-1.

Figure 8:
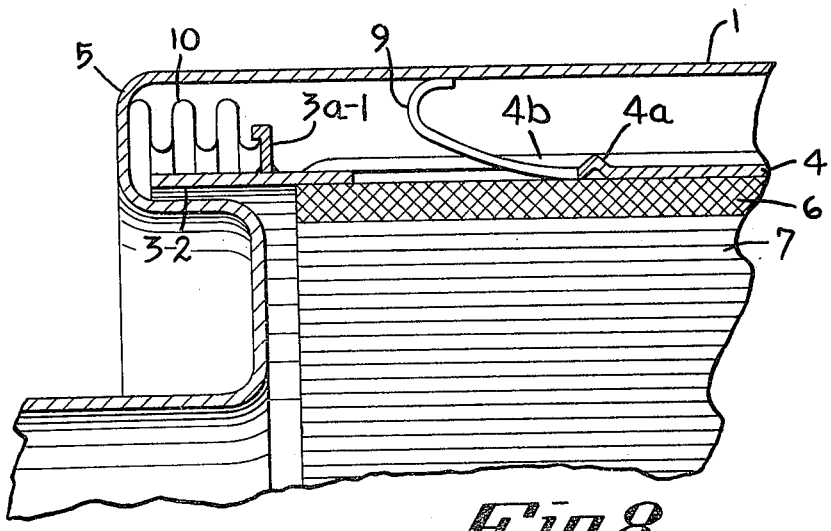
FIG. 8 is a similar view as the showing of FIG. 6 having accordion-shaped compensating means at the end of the apparatus.

FIG. 8 is similar to the embodiment illustrated in FIG. 6, however, gas-tight sealing and longitudinal compensation is provided by an accordion-shaped compensating means 10 against which the lug means 3*a*-1 of the sleeve 4 abuts and which rests at one end against the bottom of the pocket means 5 while the extension 3-2 of the sleeve 4 protrudes into the accordion-shaped compensating means as a supporting ring.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. An apparatus for cleaning exhaust gases comprising a monolithic catalyst body suitable for removing toxic gases from a gas flow through an exhaust gas passage and a holder resiliently supporting said monolithic catalyst body, said holder comprising:

a rigid housing having an inlet opening and an outlet opening and forming an outer wall of said exhaust gas passage;

a sleeve circumferentially engaging for restraint the monolithic body to restrain substantially all axial movement of the body relative to the sleeve, said sleeve and said body being disposed in said housing;

resilient tongues, each tongue having two ends, circumferentially disposed about said sleeve, said tongues engaging said sleeve near one tongue end and resiliently abutting against said housing near the other tongue end thereby resiliently supporting and centering said sleeve in, and spaced apart from, said housing; and sealing means disposed between said sleeve and said housing and being operable to restrain the passage of exhaust gases through the space therebetween.

2. An apparatus, as claimed in claim 1, wherein said sealing means comprises a structure establishing an annular groove, said structure comprising two substantially parallel and circumferentially disposed radial walls, and mineral wool supported and contained between said walls.

3. An apparatus, as claimed in claim 1, wherein said sealing means comprises a corrugated compensating means having two opposite ends and disposed circumferentially around said sleeve, one end being secured to said sleeve and the other end being secured to said housing, whereby said corrugated means is operable to restrain the passage of exhaust gases through the space between said sleeve and said housing.

4. An apparatus as claimed in claim 1, said sleeve including opposite end portions, said resilient tongues being disposed spaced apart from the end portions of said sleeve.

5. An apparatus, as claimed in claim 4, said sealing means including second annular sealing means operable to restrain hot exhaust gases from impinging upon said tongues.

6. An apparatus, as claimed in claim 1, said housing having wall portions forming annular chambers about said inlet opening and said outlet opening, said tongues being disposed near the ends of said sleeve and protruding into said chambers.

7. An apparatus, as claimed in claim 6, said sealing means including first annular sealing means disposed near said annular chambers and operable to restrain the entry of exhaust gases into said chambers.

8. An apparatus, as claimed in claim 7, said sleeve having two opposite end portions, wherein said tongues are disposed spaced apart from the end portions of said sleeve; and said sealing means further include second annular sealing means operable to restrain hot exhaust gases from impinging upon said spaced apart tongues.

9. An apparatus for cleaning exhaust gases comprising a monolithic catalyst body suitable for removing toxic gases from a gas flow through an exhaust gas passage and a holder resiliently supporting said monolithic catalyst body, said holder comprising;

a rigid housing having an inlet opening and an outlet opening and forming an outer wall of said exhaust gas passage;

a damping layer composed of mineral wool circumferentially disposed about the monolithic body;

a sleeve operable to circumferentially grip the monolithic body through said layer, said sleeve and said body being disposed in said housing;

resilient tongues, each tongue having two ends, circumferentially disposed about said sleeve, said tongues engaging said sleeve near one tongue end and resiliently abutting against said housing near the other tongue end thereby resiliently supporting and centering said sleeve in, and spaced apart from, said housing; and sealing means disposed between said sleeve and said housing and being operable to restrain the passage of exhaust gases through the space therebetween.

* * * * *